United States Patent [19]

Chamberlin

[11] Patent Number: 4,597,169

[45] Date of Patent: Jul. 1, 1986

[54] METHOD OF MANUFACTURING A TURNABLE MICROINDUCTOR

[75] Inventor: Edward R. Chamberlin, Loveland, Ohio

[73] Assignee: Standex International Corporation, Salem, N.H.

[21] Appl. No.: 617,364

[22] Filed: Jun. 5, 1984

[51] Int. Cl.[4] ..... H01F 7/06

[52] U.S. Cl. ..... 29/605; 29/593; 29/606; 336/219; 336/233

[58] Field of Search ..... 29/602 R, 593, 605, 29/606; 336/65, 219, 233, 200; 219/121 LJ, 121 LK, 121 LH

[56] References Cited

U.S. PATENT DOCUMENTS

| | | | |
|---|---|---|---|
| 2,669,528 | 2/1954 | Stelzer . | |
| 2,945,289 | 7/1960 | Spencer | 336/233 X |
| 3,548,492 | 12/1970 | Weber . | |
| 3,593,217 | 7/1971 | Weber | 336/65 X |
| 3,621,153 | 11/1971 | Wenner . | |
| 3,670,406 | 6/1972 | Weber . | |
| 3,864,824 | 2/1975 | Watson et al. . | |
| 3,874,075 | 4/1975 | Lohse . | |
| 3,908,264 | 9/1975 | Friberg et al. . | |
| 4,150,278 | 4/1979 | Resener . | |
| 4,224,500 | 9/1980 | Cruickshank et al. . | |
| 4,267,427 | 5/1981 | Nomura et al. . | |

*Primary Examiner*—Carl E. Hall

*Attorney, Agent, or Firm*—Wood, Herron & Evans

[57] ABSTRACT

A microcoil having a winding on a composite core made up of a portion of substantially magnetic material and a portion of substantially non-magnetic material. The winding is split so that a part of the magnetic material core portion is exposed, and a laser is used to remove material from the exposed part of the magnetic core portion. The inductance of the coil is measured during the removal of the magnetic material, and the inductance of the coil is trimmed to a desired value through the removal of an appropriate amount of magnetic material. The non-magnetic core portion serves as a support structure for the portions of the winding on the core even if a substantial portion of the magnetic material is removed.

5 Claims, 2 Drawing Figures

METHOD OF MANUFACTURING A TURNABLE MICROINDUCTOR

DESCRIPTION OF THE INVENTION

Figure 1:
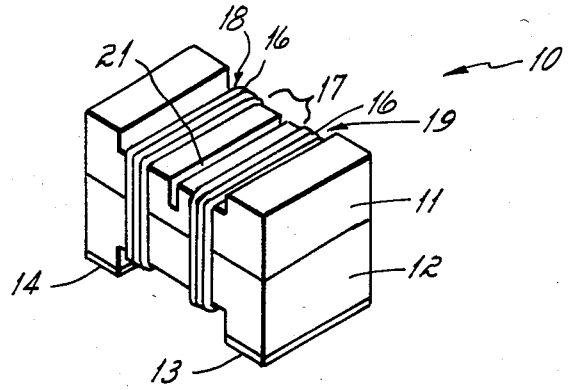

This invention relates generally to coil assemblies, and more particularly concerns a coil assembly having a core in which a portion of the core is removed to change a magnetic property of the coil to a desired value.

It has been proposed in the past to vary the magnetic properties of a coil by altering the amount of magnetic material making up the coil core. For example, abrasive-filled air, or a laser beam, has been used in the past to remove magnetic core material from a coil assembly in order to trim the inductance of the coil assembly. Typically, the inductance of the coil is measured while the magnetic core material is removed, and sufficient core material is removed to trim the inductance to the desired value. Alternatively, the coil is placed in a circuit and the performance of the circuit is monitored while magnetic core material is removed.

In such prior systems, in order to achieve a relatively large degree of inductance change in the coil, the core material is removed to form a groove or a slot in the core to thereby interrupt the magnetic flux path through the core. To provide a relatively large degree of inductance variation through such core material removal, a relatively deep groove may be required in the core. The trimmable coil assemblies known in the prior art have included either toroidal cores or pot-core constructions. In both cases, a closed magnetic path is provided in the coil assembly so that the removal of magnetic core material at any location in the magnetic core significantly affects the magnetic properties of the coil assembly. Due to the closed nature of the core in such coils, even if, as is often the case, the core is almost completely severed in the trimming operation, the mechanical stability of the core and the windings thereon is not adversely affected.

If magnetic material is removed from the core of a non-closed magnetic loop coil assembly, such as an H core or a C core for example, a cut in only a portion of the cross-section of the core can be made in order to prevent breakage of the core at the location of the cut. This restriction on the amount of magnetic material which can be removed from the core places a limit on the range of inductance trimming which can be obtained using such a non-closed magnetic loop core.

In my prior patent application Ser. No. 448,416, entitled Closed Magnetic Loop Inductor and Tuning Method, now abandoned, commonly assigned herewith, there is disclosed a chip inductor having a winding on a non-closed magnetic loop core wherein a non-magnetic material is placed over a portion of the winding, and a coating of magnetic material is applied over the non-magnetic material, extending into contact with the core at each end. The coating of magnetic material provides a low reluctance closed magnetic loop for the inductor, thereby increasing the inductance of the coil. After the coil is placed in a circuit or a test fixture, a laser cut of a given length is made in the magnetic coating to thereby reduce the coil inductance to a desired value.

It has been found that while this technique avoids the problem of weakening the core structure, there is still a limit to the trimming range of inductance which is possible. In fact, in some cases at least, the trimming range available is exceeded by the range of normal manufacturing tolerances in the production of the basic coil structure. In practice, this technique also calls for mixing magnetic particulate material in a medium such as epoxy to form the magnetic coating material. As such a mixture, this magnetic coating material has a lower density than the usual magnetic core material. The use of this lower density material in the magnetic circuit results in a lowered Q for the coil and a reduced inductance trimming range.

There are a number of advantages to coil assemblies which do not have a closed magnetic path, using, for example, I cores or H cores. Such non-closed magnetic loop coil assemblies are, for instance, used in high frequency tuned circuits to provide a higher Q. Such a non-closed magnetic path coil is also significantly easier to wind than a toroidal core coil. Since, in an H core coil for example, the coil winding is readily machine wound onto the core itself, this type of coil assembly is also substantially simpler in construction than a pot core coil. In a pot core coil construction, the coil winding is typically placed on a coil form or bobbin, which is then inserted between two halves of the pot core, which in turn must be mechanically fastened together to form the coil assembly.

In order to provide a trimmable H core coil, the removal of magnetic material from the core must be in the vicinity of the windings (where the magnetic field is substantially confined within the magnetic material) in order for the removal of magnetic material to have a significant effect upon the inductance and other magnetic properties of the coil assembly. To obtain a good range of inductance variation in trimming the coil inductance, a large amount of the magnetic material must often be removed from the core. However, this is impossible with a conventional non-closed loop core coil since the core may be completely severed or break apart into two pieces.

It is consequently an objective of the present invention to provide a trimmable coil assembly having a non-closed magnetic loop core and yet having good structural integrity, while also providing an increased inductance trimming range without significantly reducing the Q of the coil.

As shall be described hereinafter with regard to a particular embodiment of the invention, this objective is met in accordance with one aspect of the present invention by a coil assembly having a bimaterial core. One core material has substantially magnetic properties and the other core material has substantially non-magnetic properties. The coil winding encircles the bimaterial core in a fashion to expose a part of the magnetic core material. After the coil is assembled, it is inserted in a circuit or a test fixture wherein a magnetic parameter such as inductance is measured while a laser is used to remove a portion of the exposed magnetic core material. Preferably the magnetic material is removed in the form of a groove or slot to reduce the effective cross section of the magnetic core material. This removal of magnetic material reduces the inductance of the coil assembly, and, in the case of inductance trimming, magnetic material is removed by the laser until the inductance has been trimmed to the desired value.

In the illustrated form of the invention, the coil windings are split into two sections leaving an intermediate exposed part of the magnetic core material therebetween. The non-magnetic core material is not removed by the laser, and cooperates with the magnetic material at the location of the winding sections to support the windings. In the intermediate area between the winding sections, the non-magnetic core material provides mechanical strength holding the two winding sections in fixed position relative to one another, maintaining the structural integrity of the coil assembly, even if a substantial groove is cut through the magnetic core material.

Figure 2:
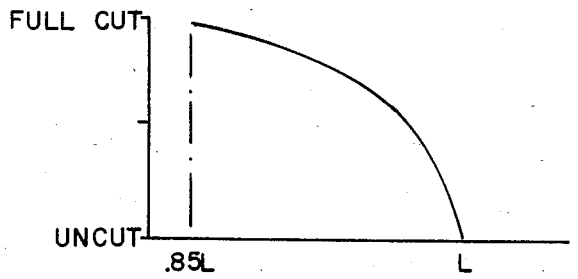

Other objects and advantages of the invention, and the manner of their implementation, will become apparent upon reading the following detailed description and upon reference to the drawings, in which:

FIG. 1 is a perspective view of a coil assembly constructed in accordance with the present invention; and FIG. 2 is a graphic illustration of the range of inductance trimming for the coil assembly of FIG. 1.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With reference initially to FIG. 1, a microcoil assembly 10 includes an H core made up of a portion 11 of magnetic material and a portion 12 of non-magnetic material. The magnetic material for the core portion 11 is a material having a substantial effect upon the magnetic properties of the coil assembly 10. In the illustrated coil assembly, the magnetic material is a carbonyl pressed iron material. The specific material for the core portion 11 may be selected from, for example, various types of pressed iron core materials, such as carbonyl "E", "C" or "J" material, or types of pressed and fired ferrites.

Ferrites have higher magnetic permeability and therefore provide a higher inductance and a greater trimming range, but the ferrites are also slower and more difficult to trim using a laser (the use of which is described hereinafter) due to the higher density of the ferrites. The carbonyls generally provide higher Q's at high frequencies.

The non-magnetic portion 12 of the core is provided for mechanical strength, as shall be explained, and may be selected from a wide range of materials which are mechanically suited for the application. In the illustrated coil assembly, the two core portions 11, 12 are bonded together to form an H core. Suitable electrically conductive pads 13, 14 are also bonded or plated onto the feet of the portion 12 of the core. A winding 16 is wrapped on the core 11, 12 in a manner to leave a part 17 of the magnetic core portion 11 exposed. In order to do this, in the illustrated coil assembly 10, the winding 16 is made up of two winding sections 18, 19 positioned on opposite sides of the exposed part 17 of the core. The ends (not shown) of the winding 16 are electrically connected to the pads 13, 14, which are subsequently coupled to a circuit in which the coil assembly is to be used, such as by soldering the pads 13, 14 to a circuit-board.

The coil winding 16 is wound on the core to leave the exposed space 17 to permit cutting of the magnetic portion 11 of the core by a laser beam to trim the inductance of the coil assembly 10 to a desired value. In order to connect the two coil sections 18, 19, a crossover wire (not shown) between the sections of the winding is placed on the bottom of the core to permit cutting the magnetic portion 11 of the core without cutting the wires of the winding 16.

A laser is used to cut away magnetic material from the area 17 of the portion 11 of the core to form a notch or groove 21 in the magnetic material of the core. While the magnetic material is removed, the inductance of the coil assembly 10 is monitored, and the laser cutting is stopped when then inductance is trimmed to its desired value.

Rather than measuring the inductance of the coil assembly 10 while the magnetic material is removed by the laser, a customer may place the coil assembly in a circuit and laser cut the groove 21 to obtain desired circuit performance. In an exemplary customer application, the coil assembly 10 is soldered onto a circuit-board, and the magnetic material in the core portion 11 is laser cut until the desired circuit performance is obtained. The laser is controlled to cut through the top core portion 11 but not the bottom core portion 12. In this way, the magnetic material can, if necessary, be cut completely through, allowing the maximum inductance trimming range while the core still provides a solid coil form even after such a full cut.

In a typical microcoil of the form shown in FIG. 1, a Q may be obtained having an initial value of, for example, 55 before the core portion 11 is cut, with a reduction in Q of less than 5% for a full cut through the magnetic core portion. As shown in FIG. 2, a typical inductance reduction for a microcoil of the form of FIG. 1 is about 15%, between the uncut and fully cut conditions of the magnetic core portion 11.

While the invention has been described in connection with an H core coil, it will be understood that it is also applicable to other core configurations of the type providing a non-closed magnetic path. The core is preferably made up of a first portion which contributes significantly to the magnetic properties of the coil assembly and a second portion which does not contribute significantly to the magnetic properties of the coil assembly. The magnetic material portion of the core is then supported structurally by the non-magnetic portion of the core so that, if required to obtain the desired magnetic properties for the coil assembly, the portion of the core contributing substantially to the magnetic properties can be totally severed while the structural integrity of the coil assembly is maintained. This structural integrity for the coil assembly permits a full cut of the magnetic material portion of the core at a location at the windings where the magnetic field in the core is of high intensity, enhancing the range of trimming obtained.

What is claimed is:

1. The method of manufacturing a tunable microinductor comprising the steps of:

bonding a magnetic bar to a nonmagnetic support, winding a conductive coil around said bar and support in two laterally-spaced winding sections, said winding sections leaving between them an exposed portion of said magnetic bar, thereby creating an open loop inductor, mounting said inductor in an electrical circuit, energizing said electrical circuit, and trimming away magnetic material from said exposed portion between said windings while the circuit is energized until the inductance of said inductor is such that the circuit attains the desired level of performance.

2. The method of claim 1 in which, in the step of selectively removing material, the removal of the material is accomplished by the use of a laser.

3. The method of claim 1 further comprising the step of:

connecting the ends of said winding to pads on bottom of said support opposite said magnetic bar, and surface mounting said inductor on a printed circuitboard prior to trimming said magnetic material.

4. The method as in claim 1 wherein said inductor is mounted in inductance measuring apparatus during the step of trimming away the magnetic material.

5. The method as in claim 1 wherein said magnetic bar is U-shaped and said nonmagnetic support is of an inverted U-shape, bonding the central portions of said U shape together to form an H-shaped core having a central crossbar, and forming said winding about said central crossbar.

* * * * *